US005174141A

United States Patent [19]

Ohyabu

[11] Patent Number: 5,174,141

[45] Date of Patent: Dec. 29, 1992

[54] CYLINDER LOCK

[75] Inventor: Yoshinobu Ohyabu, Aichi, Japan

[73] Assignee: Kabushiki Kaisha Tokai Rika Denki Seisakusho, Aichi, Japan

[21] Appl. No.: 609,607

[22] Filed: Nov. 6, 1990

[30] Foreign Application Priority Data

Nov. 10, 1989 [JP] Japan ..... 1-131340[U]

[51] Int. Cl.[5] ..... E05B 27/00

[52] U.S. Cl. ..... 70/492; 70/377; 70/419; 70/421

[58] Field of Search ..... 70/491, 492, 350, 351, 70/358, 360, 377, 419, 421

[56] References Cited

U.S. PATENT DOCUMENTS

| | | | |
|---|---|---|---|
| 2,035,181 | 3/1936 | Molinare | 70/92 |
| 2,079,628 | 5/1937 | Olson | 70/492 |
| 2,155,734 | 4/1939 | Olson | 70/492 X |
| 2,248,475 | 7/1941 | Hamilton | 70/492 |
| 3,035,433 | 5/1962 | Testa | 70/419 X |
| 3,263,461 | 8/1966 | Tartaglia | 70/492 X |
| 3,581,534 | 6/1971 | Testa | 70/492 X |
| 3,707,863 | 1/1973 | Schwab et al. | 70/492 |
| 3,854,311 | 12/1974 | Mercurio | 70/377 X |
| 4,052,870 | 10/1977 | Degye et al. | 70/492 |
| 4,074,551 | 2/1978 | Lipschutz | 70/492 |
| 4,434,636 | 3/1984 | Prunbauer | 70/421 X |

FOREIGN PATENT DOCUMENTS

| | | | |
|---|---|---|---|
| 1957642 | 9/1971 | Fed. Rep. of Germany | 70/492 |
| 2146849 | 11/1977 | Fed. Rep. of Germany | 70/492 |
| 2704478 | 8/1978 | Fed. Rep. of Germany | 70/492 |
| 702773 | 3/1966 | Italy | 70/377 |
| 488914 | 5/1970 | Switzerland | 70/377 |

*Primary Examiner*—Richard E. Moore
*Assistant Examiner*—Suzanne L. Dino
*Attorney, Agent, or Firm*—Finnegan, Henderson, Farabow, Garrett and Dunner

[57] ABSTRACT

In a cylinder lock, half tumblers are slidably arranged in pairs in the tumbler inserting holes formed in the key rotor in such a manner that, when the key is not inserted into the lock, the half tumblers are elastically urged in one direction to cause their engaging end portions to engage with the locking engagement grooves formed in the cylinder body to inhibit the rotation of the key rotor. When the key is inserted into the lock, the key engaging portions of the half tumblers engage the key crests to move the half tumblers to disengage their engaging end portions from the locking engagement grooves. When, instead of the key, a picking tool is used to disengage one of each pair of half tumblers from the locking engagement groove to thereby allow the key rotor to turn through a predetermined angle, the other half tumbler is engaged with the locking engagement groove deeper than usual, and the protruded portion of the key rotor covers the key engaging portion, thereby preventing the picking of the lock.

14 Claims, 4 Drawing Sheets

CYLINDER LOCK

BACKGROUND OF THE INVENTION

This invention relates to a cylinder lock with pairs of half tumblers inserted into the tumbler inserting holes formed in the key rotor.

The so-called "picking" of a cylinder lock, i.e., a cylinder lock being unlocked dishonestly without its key, may be effectively prevented by increasing the number of tumblers which are slidably engaged with the locking engagement grooves of the cylinder body. However, since it is impossible to reduce the pitch of arrangement of the tumblers in the key rotor to an extremely small value; that is, the pitch of arrangement of the tumblers in the key rotor is limited, the number of tumblers is determined from the length of the key rotor or key. In order to overcome this limitation, a method has been disclosed in which two half tumblers are inserted in one tumbler inserting hole, so that the number of tumblers is increased with the length of the key rotor or key maintained unchanged.

It is true that the number of tumblers can be increased by inserting two half tumblers in each tumbler inserting hole. However, the conventional cylinder lock of this type has a minimum fear that the lock may be picked when, with the key rotor turned slightly by picking one of the half tumblers, the other half tumbler is picked. Although it is impossible to practically pick the conventional cylinder lock of this type by the manner noted above because the picking will take much time and labor, it is required to provide a cylinder lock which is more positively protected from picking.

SUMMARY OF THE INVENTION

Accordingly, an object of this invention is to provide a cylinder lock which is more positively protected from picking.

The foregoing object and other objects of the invention have been achieved by the provision of a cylinder lock which, according to the invention, comprises: a cylinder body with a rotor inserting hole including locking engagement grooves formed in the wall of the hole; a key rotor with a key inserting hole, the key rotor being rotatably inserted into the rotor inserting hole of the cylinder body, the key rotor having tumbler inserting holes which are each extended perpendicular to the key inserting hole with both ends opened in the outer wall of the key rotor; half tumblers slidably arranged in pair in the tumbler inserting holes, the half tumblers being urged in one direction by spring members when no key is inserted into the lock, to cause engaging end portions to engage with the locking engagement grooves, to inhibit the rotation of the key rotor; the half tumblers having key engaging portions which, when the key is inserted into the key inserting hole, engage with the crests of the key to move the half tumblers to disengage the engaging end portions from the locking engagement grooves, and guide portions which, when one of each pair of half tumblers is disengaged from the locking engagement groove by being moved with picking means other than the key, and the key rotor is turned through a predetermined angle, causes the other half tumbler to engage with the locking engagement groove deeper than usual, the key rotor having protruded portions which cover the key engaging portions when the lock plate is engaged deeper with the locking engagement groove than usual.

When, in the cylinder lock of the invention, one of each pair of half tumblers is moved with a picking means other than the key, so that its engaging end portion is disengaged from the locking engagement groove, and accordingly the key rotor is turned through the predetermined angle; the other half tumbler is engaged deeper with the locking engagement groove than usual, whereby the key engaging portion of the latter half tumbler is covered by the protruded portion of the rotor. Hence, it is difficult to move the half tumbler with the picking tool engaged with that portion. That is, the picking of the lock can be positively prevented.

The nature, principle and utility of the invention will become more apparent from the following detailed description when read in conjunction with the accompanying drawings.

DETAILED DESCRIPTION OF THE INVENTION

One example of a cylinder lock according to this invention will be described with reference to the accompanying drawings.

Figure 1:
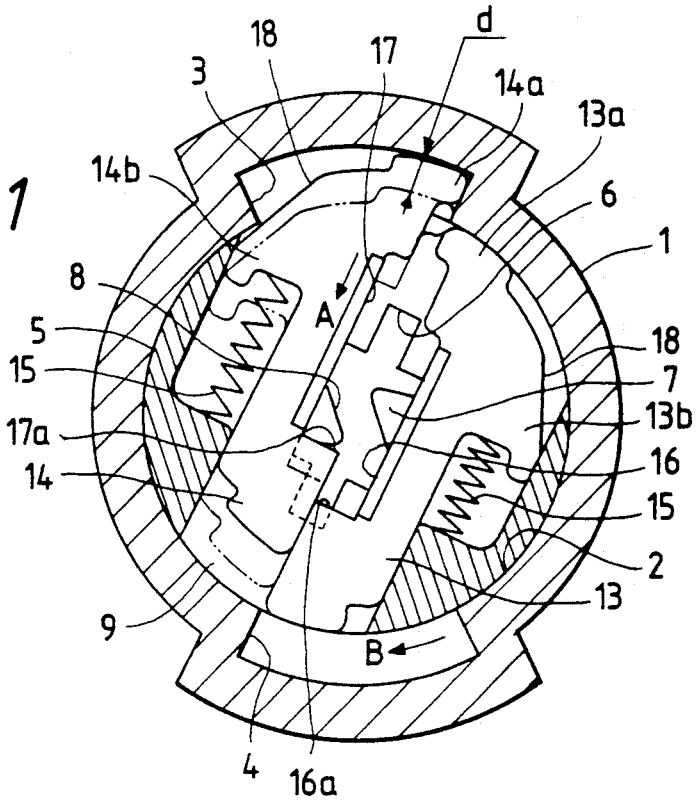
FIG. 1 is a cross sectional view showing one phase of one example of a cylinder lock embodying this invention in which the picking is prevented.
Figure 2:
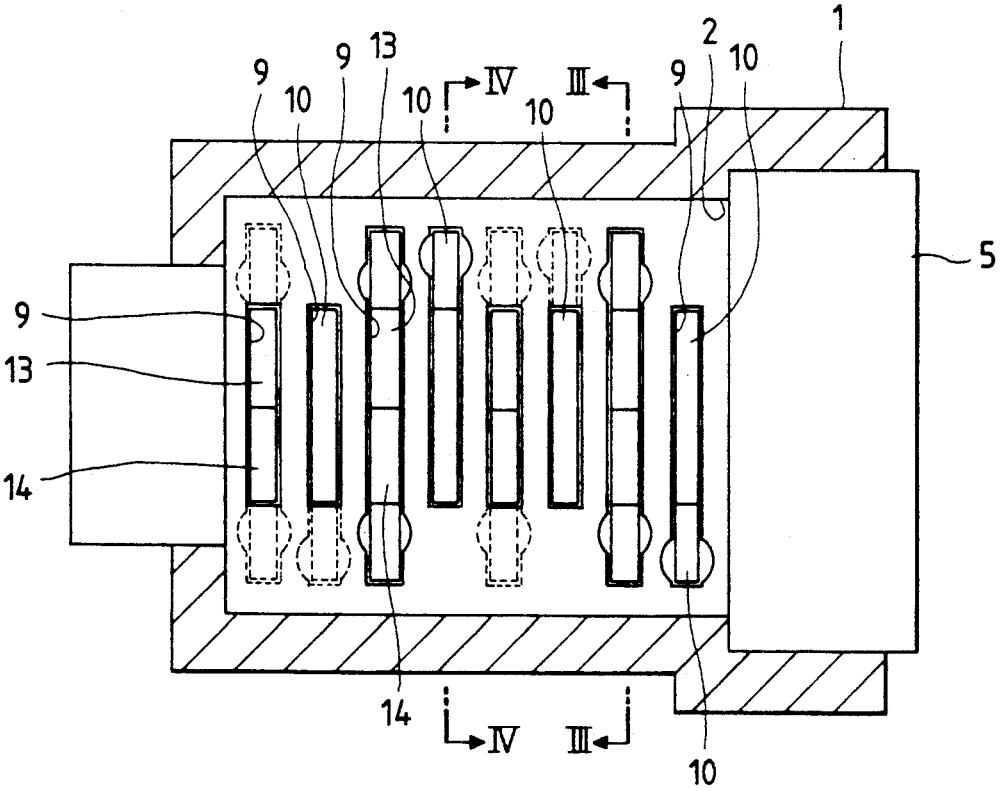
FIG. 2 is a side view, with parts cut away, of the cylinder lock according to the invention.
Figure 4:
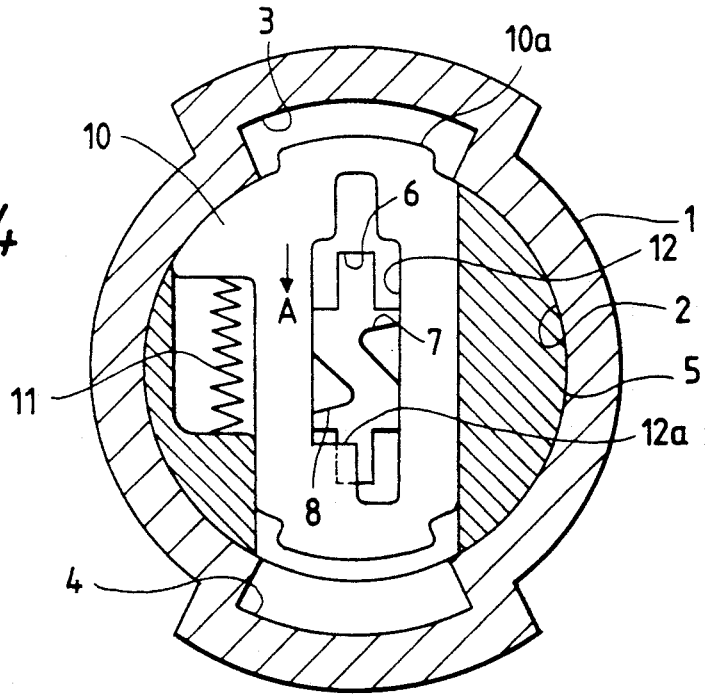
FIG. 4 is a cross sectional view taken along line IV—IV in FIG. 2.

As shown in FIGS. 1 and 2, a cylinder body 1 has a rotor inserting hole 2, which includes a pair of locking engagement grooves 3 and 4 which are diametrically opposite to each other. A key rotor 5 is rotatably inserted into the rotor inserting hole 2. The key rotor 5 has a key inserting hole 6 which is extended along the central axis of the key rotor 5. The key inserting hole 6 is shaped so as to receive a key (described later). The key inserting hole 6 has inwardly protruded portions, namely, protrusions 7 and 8 on its inner wall which are engaged with reduced portions, namely, recesses (described later) formed in the key. As shown in FIG. 2, a predetermined number of slit-shaped lock plate inserting holes 9 (eight locking plate inserting holes in the example) are formed in the key rotor 5 in such a manner that they are extended perpendicular to the key inserting hole 6 and to communicate with the key inserting hole latter 6. Full tumblers 10 as shown in FIG. 4 are slidably inserted in every other lock plate inserting hole 9. When the key is not inserted into the lock yet, engaging portions 10*a* of the full tumblers 10 are engaged with the locking engagement grooves 3 or 4 by the elastic forces of coil springs 11. The full tumblers 10 have key inserting holes 12 at the center. The key inserting holes 12 have key engaging portions 12*a* which are engaged with the crests of the key when the key is inserted into the lock.

Figure 3:
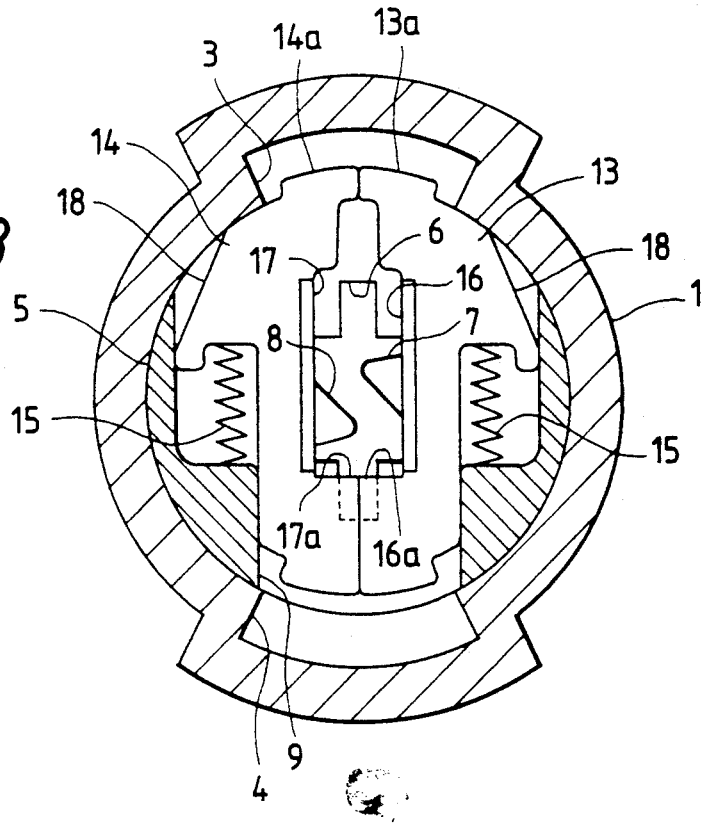
FIG. 3 is a cross sectional view taken along line III—III in FIG. 2.

Inserted slidably in each of the remaining lock plate inserting holes 9 are two half tumblers 13 and 14 with engaging portions 13*a* and 14*a* at one end. When the key is not inserted into the lock, the engaging portions 13*a* and 14*a* are engaged with the locking engagement grooves 3 or 4 by the elastic forces of coil springs 15 and 15 as shown in FIG. 3. More specifically, the two half tumblers 13 and 14 are so arranged that their adjacent edges are abutted against each other on the central axis of the symmetrical lock plate inserting hole 9. The half tumblers 13 and 14 have key inserting recesses 16 and 17 in their portions confronting with the key inserting hole. The key inserting recesses 16 and 17 have key engaging portions 16*a* and 17*a* with which the crests of the key (described later) are engaged, and chamfered portions 16*b* and 17*b* which confront with the main portion of the key (described later), respectively. The half tumblers 13 and 14 have guide portions 18 and 18 in the parts of their spring receiving protruded portions 13*b* and 14*b*, respectively, which confront with the inner wall of the rotor inserting hole 2 in such a manner that they are spaced away from the rotor inserting hole 2.

Figure 6:
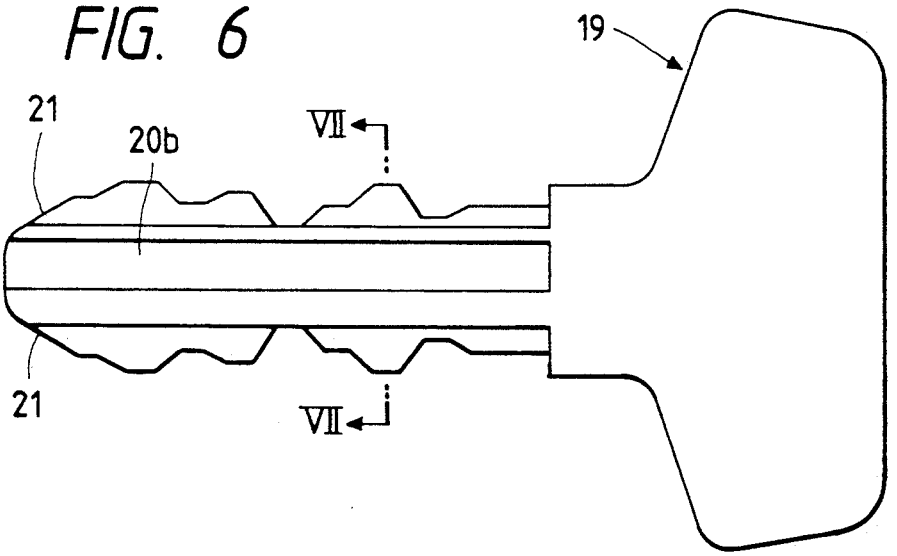
FIG. 6 is a side view of the key provided for the cylinder lock according to the invention.
Figure 7:
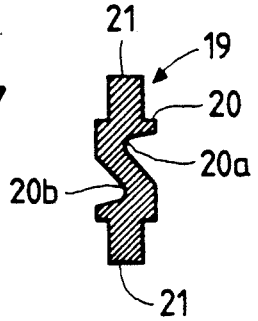
FIG. 7 sectional view taken along line VII—VII in FIG. 6.

The key 19 for the above-described cylinder lock is as shown in FIGS. 6 and 7. The key 19 has the aforementioned key main portion 20 which is substantially rectangular in section. The key main portion 20 has recessed portions 20*a* and 20*b* which are engaged with the protruded portions 7 and 8 of the key inserting hole 6. Key crests forming portions 21, extended outwardly from the key main portion 20, are made smaller in thickness than the key main portion 20 so that key crests can o be formed by press-cutting. The dimensions of the key inserting hole 6 of the key rotor 5 are so determined as to permit the passage of the highest of the key crests which are formed in the key crest forming portions 21 as shown in FIG. 6.

The operation of the cylinder lock thus constructed will be described.

When the key 19 is inserted into the key inserting hole 6 of the key rotor 5, the full tumblers 10 and the half tumblers 13 and 14 are moved by the key 19 in the direction of the arrow A against the elastic forces of the coil springs 11 and 15 since the key crests formed in the key crest forming portions 22 are engaged with the key engaging portions 12*a* of the full tumblers 10 and with the key engaging portions 16*a* and 17*a* of the half tumbler portions 13 and 14. As a result, the ends of the engaging portions 10*a*, 13*a* and 14*a* are made flush with the outer wall of the key rotor 5, so as to be disengaged from the locking engagement grooves 3 and 4. Thus, the key rotor 5 can be turned with the key 19 (cf. FIG. 5).

Now, the case where the "picking"0 of the lock is carried out by using a picking tool instead of the regular key will be described.

FIG. 1 shows the state of the lock that the picking of the all the full tumblers 10 and all the right half tumblers 13 has been achieved, so that the key rotor 5 is turned through about 26° in the direction of the arrow B. In this state, the engaging portions 13*a* of the right half tumblers 13 and the engaging portions 10*a* of the full tumblers 10 are flush with the wall of the rotor inserting hole 1, and are not capable of inhibiting the rotation of the key rotor 5. On the other hand, under this condition, the guide portions 18 of the left half tumblers 14 are engaged with and guided by the open end 3*a* of the locking engagement groove 3, and therefore the left half tumblers 14 are deeply engaged with the locking engagement groove 3, being moved a distance (d) in the direction opposite to the direction of the arrow A from the position shown in FIG. 3 (or indicated by the two-dot chain line in FIG. 1). At the same time, the key engaging portion 17*a* of each half tumbler 14 is moved the distance (d) in the direction opposite to the direction of the arrow A from its normal position, so that the key engaging portion 17*a* is covered by the protruded portion 8 of the key inserting hole 6. Accordingly, it is difficult to engage the picking tool with the key engaging portion 17*a* to move the half tumbler 14 in the direction of the arrow A; that is, the picking of the lock can be positively prevented.

Figure 5:
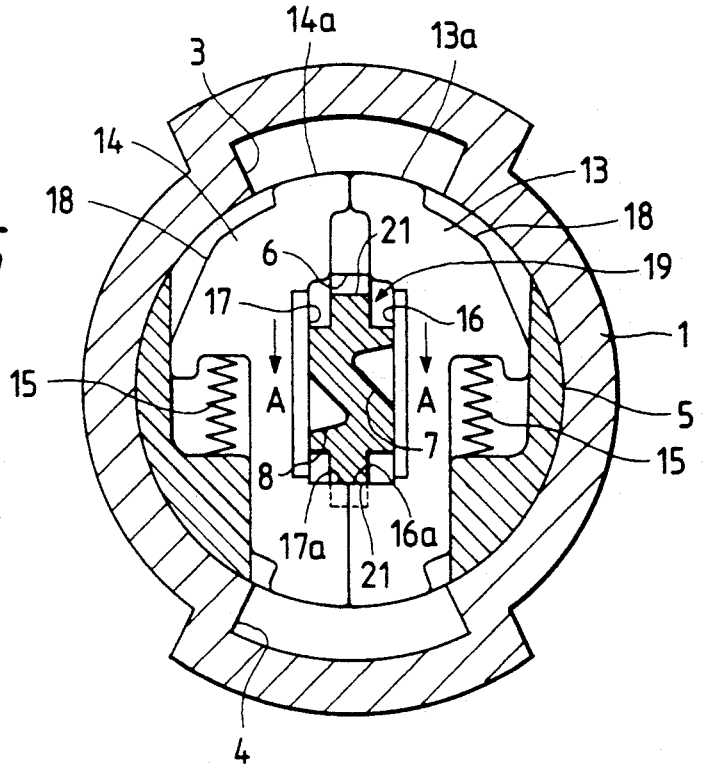
FIG. 5 is a cross sectional view, corresponding to FIG. 3, showing another phase of the cylinder lock according to the invention.
Figure 8:
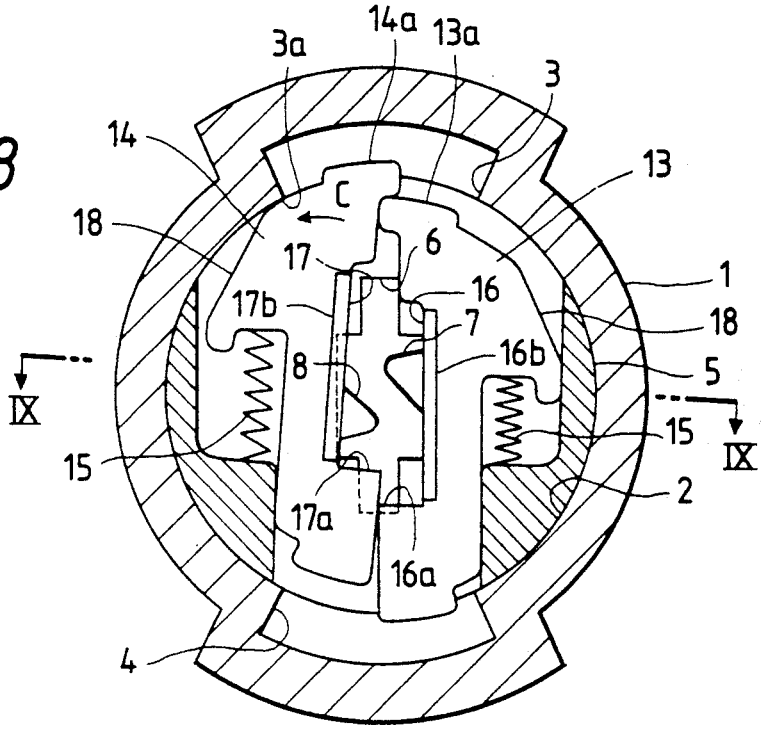
FIG. 8 is a sectional view showing another phase of the cylinder lock according to the invention.
Figure 9:
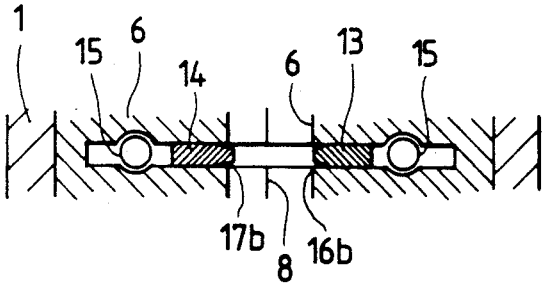
FIG. 9 is a sectional view taken along line IX—IX in FIG. 8.

When the picking is suspended in the state shown in FIG. 1, then the locking is maintained unchanged; that is, the lock is prevented from being unlocked dishonestly. Under this condition, it is impossible to fully insert the key 19 into the key inserting hole 6 because the key engaging portion 17*a* of each half tumbler 14 is covered with the protruded portion 8 of the key inserting hole 6 as was described above. However, if the end portion of the key 19 is inserted into the key inserting hole 6, then the key rotor 5 can be turned in the direction opposite to the direction of the arrow B. When the key rotor 5 is turned in this manner, then the half tumblers 13 and 14 are positioned as shown in FIG. 8. In this case, the guide portion 18 of each half tumbler 14 is disengaged from the open end 3*a* of the locking engagement groove 3, and the engagement depth of the half tumbler 14 with the locking engagement groove 3 is restored to the normal value as shown in FIG. 3. Therefore, upon insertion of the key 19 into the key inserting hole 6, the main portion 20 of the key 19 abuts against the chamfered portion 17*b* of the half tumbler 14, so that the half tumbler 14 is displaced in the direction of the arrow C in FIG. 8, thus permitting the sufficient insertion of the key 19. Hence, when the key 19 is inserted into the key inserting hole 6, the half tumbler 14 is set as shown in FIG. 5, so that the lock can be unlocked in the normal way.

In the above-described embodiment of the invention, the locking engagement grooves 3 and 4, with which the engaging portions 13*a* and 14*b* are engaged, are each a continuous one with no intermediate partition member or the like, and therefore the key crests forming portions 21 of the key 19 may be small in thickness. Accordingly, the key crests can be formed by press-cutting. That is, the key can be manufactured at lower cost than that which is formed by grinding.

In one example of the conventional cylinder lock, the locking engagement grooves (3 and 4) have intermediate partition walls so that the half tumblers are engaged with the respective locking engagement grooves. In the conventional cylinder lock, because of the drawing of the cylinder body, it is difficult to arrange the full tumblers and the half tumblers alternately in the axial direction, and therefore it is difficult to positively prevent the picking. In addition, the key crest forming portions of the key are larger in thickness, and therefore it is rather difficult to form the key crests by press-cutting, with the result that the formed key is higher in manufacturing cost. On the other hand, in the cylinder lock of the invention, it is unnecessary for the locking engagement grooves to have such intermediate partition walls, and the picking is positively prevented, and the manufacturing cost is low.

The conventional cylinder lock with the partition walls in the locking engagement grooves may be modified to have portions corresponding to the guide portions 18 of the cylinder lock of the invention. However, in the modification, it is difficult to cause the half tumblers to engage with the locking engagement grooves deeper during picking. That is, in the conventional cylinder lock, unlike the cylinder lock of the invention, it is difficult to cover the key engaging portion with the protruded portion, and therefore it is difficult to effectively prevent the picking.

As was described above, in the cylinder lock according to the invention, the cylinder body has the rotor inserting hole including the locking engagement grooves formed in the wall of the hole, the key rotor with the key inserting hole is rotatably inserted into the rotor inserting hole of the cylinder body, the key rotor having the tumbler inserting holes which are each extended perpendicular to the key inserting hole with both ends opened in the outer wall of the key rotor, and the half tumblers slidably arranged in pair in the tumbler inserting holes are urged in one direction by the spring members when no key is inserted into the lock, to cause their engaging end portions to engage with the locking engagement grooves, to inhibit the rotation of the key rotor, the half tumblers having the key engaging portions which, when the key is inserted into the key inserting hole, engage with the crests of the key to move the half tumblers to disengage the engaging end portions from the locking engagement grooves, and the guide portions which, when one of each pair of half tumblers is disengaged from the locking engagement groove by being moved with picking means other than the key, and the key rotor is turned through a predetermined angle, causes the other half tumbler to engage with the locking engagement groove deeper than usual, the key rotor having the protruded portions which cover the key engaging portions when the lock plate is engaged deeper with the locking engagement groove than usual. Hence, it is difficult to move the other half tumbler with the picking tool engaged with it. Thus, the "picking" of a lock that is unlocking the lock without using its key, can be positively prevented.

While the invention has been described in connection with the preferred embodiment of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A cylinder lock comprising:

a cylinder body including a rotor inserting hole and a continuous locking engagement groove formed in a wall of the cylinder body;

a key rotor rotatably positioned in the rotor inserting hole, the key rotor including a key inserting hole and tumbler inserting holes extending perpendicular to the key inserting hole, each of the tumbler inserting holes having two ends opening in an outer wall of the key rotor; and at least one pair of half tumblers slidably arranged in the tumbler inserting holes, each of the half tumblers including an engaging end portion, the pair of half tumblers being urged in one direction by a spring member to cause the engaging end portions to extend into the continuous locking engagement groove when no key is inserted into the key inserting hole to inhibit the rotation of the key rotor, key engaging portion means for moving the half tumbler to disengage the engaging end portion from the locking engagement groove when a key is inserted into the key inserting hole and the crests of the key engage the key engaging portion means, means for inhibiting movement of the half tumbler into the continuous locking engagement groove beyond a first depth, and a guide portion for enabling the half tumbler to move into the continuous locking engagement groove to a second depth deeper than the first depth when the other half tumbler of the pair of half tumblers is disengaged from the locking engagement groove by being moved with picking means other than the key and the key rotor is turned through a predetermined angle.

2. The cylinder lock of claim 1, wherein the key rotor has means for covering the key engaging portion means of a half tumbler as said half tumbler is moved farther into the locking engagement groove.

3. The cylinder lock of claim 2, wherein the covering means includes a protruding portion extending from the key rotor.

4. The cylinder lock of claim 1, wherein the key rotor has two continuous locking engagement grooves positioned facing one another.

5. The cylinder lock of claim 1, further comprising full tumblers slidably positioned in corresponding tumbler inserting holes, the full tumblers being urged in one direction by a spring member to cause engaging end portions of the full tumblers to extend into the locking engagement groove when no key is inserted into the key inserting hole to inhibit the rotation of the key rotor.

6. The cylinder lock of claim 5, wherein pairs of half tumblers and the full tumblers are alternately arranged along the axial direction of the key rotor.

7. A cylinder lock comprising:

a cylinder body including a rotor inserting hole and a locking engagement groove formed in a wall of the cylinder body;

a key rotor rotatably positioned in the rotor inserting hole, the key rotor including a key inserting hole, protruding portions, and tumblers inserting holes extending perpendicular to the key inserting hole, each of the tumbler inserting holes having two ends opening in an outer wall of the key rotor; and at least one pair of half tumblers slidably arranged in the tumbler inserting holes, each of the half tumblers including an engaging end portion, the pair of half tumblers being urged in one direction by a spring member to cause the engaging end portions to extend into the locking engagement groove when no key is inserted into the key inserting hole to inhibit the rotation of the key rotor, key engaging portion means for moving the half tumbler to disengage the engaging end portion from the locking engagement groove when a key is inserted into the key inserting hole and the crests of the key engage the key engaging portion means, and a guide portion for enabling the half tumbler to move farther into the locking engagement groove when the other half tumbler of the pair of half tumblers is disengaged from the locking engagement groove by being moved with picking means other than the key and the key rotor is turned through a predetermined angle, a corresponding one of the protruding portions covering the key engaging portion means of a half tumbler responsive to said half tumbler moving farther into the locking engagement groove.

8. The cylinder lock of claim 7, wherein the key rotor has two locking engagement grooves positioned facing one another.

9. The cylinder lock of claim 7, further comprising full tumblers slidably positioned in corresponding tumbler inserting holes, the full tumblers being urged in one direction by a spring member to cause engaging end portions of the full tumblers to extend into the locking engagement groove when no key is inserted into the key inserting hole to inhibit the rotation of the key rotor.

10. The cylinder lock of claim 9, wherein pairs of half tumblers and the full tumblers are alternately arranged along the axial direction of the key rotor.

11. A cylinder lock comprising:

a cylinder body including a rotor inserting hole and a continuous locking engagement groove formed in a wall of the cylinder body;

a key rotor rotatably positioned in the rotor inserting hole, the key rotor including a key inserting hole and tumbler inserting holes extending perpendicular to the key inserting hole, each of the tumbler inserting holes having two ends opening in an outer wall of the key rotor; and at least one pair of half tumblers slidably arranged in the tumbler inserting holes, each of the half tumblers including an engaging end portion, the pair of half tumblers being urged in one direction by a spring member to cause the engaging end portions to extend into the continuous locking engagement groove when no key is inserted into the key inserting hole to inhibit the rotation of the key rotor, key engaging portion means for moving the half tumbler to disengage the engaging end portion from the locking engagement groove when a key is inserted into the key inserting hole and the crests of the key engage the key engaging portion means, and a guide portion for enabling the half tumbler to move farther into the continuous locking engagement groove when the other half tumbler of the pair of half tumblers is disengaged from the locking engagement groove by being moved with picking means other than the key and the key rotor is turned through a predetermined angle, wherein the key rotor has means for covering the key engaging portion means of a half tumbler as said half tumbler is moved farther into the locking engagement groove, the covering means including a protruding portion extending from the key rotor.

12. The cylinder lock of claim 11, wherein the key rotor has two continuous locking engagement grooves positioned facing one another.

13. The cylinder lock of claim 11, further comprising full tumblers slidably positioned in corresponding tumbler inserting holes, the full tumblers being urged in one direction by a spring member to cause engaging end portions of the full tumblers to extend into the locking engagement groove when no key is inserted into the key inserting hole to inhibit the rotation of the key rotor.

14. The cylinder lock of claim 13, wherein pairs of half tumblers and the full tumblers are alternately arranged along the axial direction of the key rotor.

* * * * *

UNITED STATES PATENT AND TRADEMARK OFFICE

CERTIFICATE OF CORRECTION

PATENT NO. : 5,174,141

DATED : December 29, 1992

INVENTOR(S) : Yoshinobu Ohyabu

It is certified that error appears in the above-identified patent and that said Letters Patent is hereby corrected as shown below:

Claim 7, Column 6, Line 52 change "tumblers" to --tumbler--.

Signed and Sealed this

Twenty-first Day of December, 1993

Attest:

Bruce Lehman

BRUCE LEHMAN

Attesting Officer

Commissioner of Patents and Trademarks